US009739455B2

(12) United States Patent
Rodriguez et al.

(10) Patent No.: US 9,739,455 B2
(45) Date of Patent: Aug. 22, 2017

(54) LED LIGHT ENGINES

(71) Applicant: ABL IP HOLDING LLC, Conyers, GA (US)

(72) Inventors: Yan Rodriguez, Suwanee, GA (US); Leslie Charles King, Loganville, GA (US); Jorge Santos, Nuevo Leon (MX); Michael Bruce, Atlanta, GA (US)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 13/829,719

(22) Filed: Mar. 14, 2013

(65) Prior Publication Data

US 2013/0271982 A1 Oct. 17, 2013

Related U.S. Application Data

(60) Provisional application No. 61/687,056, filed on Apr. 17, 2012.

(51) Int. Cl.

| | |
|---|---|
| ***F21K 9/20*** | (2016.01) |
| ***F21V 15/01*** | (2006.01) |
| ***F21V 19/00*** | (2006.01) |
| ***F21V 19/04*** | (2006.01) |
| ***F21V 21/04*** | (2006.01) |

(Continued)

(52) U.S. Cl.

CPC ..... *F21V 15/01* (2013.01); *F21V 19/001* (2013.01); *F21V 19/045* (2013.01); *F21V 21/046* (2013.01); *F21K 9/20* (2016.08); *F21S 8/026* (2013.01); *F21V 13/04* (2013.01); *F21V 31/00* (2013.01); *F21Y 2101/00* (2013.01); *F21Y 2105/10* (2016.08); *F21Y 2115/10* (2016.08); *Y10T 29/49128* (2015.01)

(58) Field of Classification Search

CPC .... F21Y 2101/02; F21Y 2103/00; F21K 9/00; F21S 4/003; F21S 8/02; F21W 2121/004; E04B 9/006; F21V 33/06; F21V 21/04; F21V 21/30; F21V 17/00; F21V 17/06; F21V 17/16; F21V 17/104; F21V 17/162; F21V 17/164; F21V 17/166; F21V 15/01; F21V 15/012; F21V 21/044

USPC ..... 362/235, 145, 147, 148, 150, 364

See application file for complete search history.

(56) References Cited

U.S. PATENT DOCUMENTS

| | | | |
|---|---|---|---|
| 4,399,497 | A | 8/1983 | Druffel |
| 4,754,377 | A | 6/1988 | Wenman |

(Continued)

*Primary Examiner* — Jong-Suk (James) Lee
*Assistant Examiner* — Mark Tsidulko
(74) *Attorney, Agent, or Firm* — Kilpatrick Townsend & Stockton, LLP

(57) ABSTRACT

An LED light engine includes a housing, one or more LEDs mounted on a printed circuit board and a retention feature engaged with the housing. The retention feature includes one or more of a torsion spring and a friction clip and is configured to engage an inside wall of a recessed lighting can, thereby retaining the LED light engine within the can. The LED light engine may also include a reflector and a lens retained within the housing, with the housing, reflector and lens forming a sealed chamber for protecting the LED components from external environmental conditions. Methods for retrofitting an existing recessed downlight fixture with an LED light engine include removing the existing light engine from the recessed lighting can and inserting an LED light engine into the can.

15 Claims, 9 Drawing Sheets

(51) Int. Cl.

| | |
|---|---|
| *F21V 31/00* | (2006.01) |
| *F21S 8/02* | (2006.01) |
| *F21V 13/04* | (2006.01) |
| *F21Y 101/00* | (2016.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 4,829,410 | A | 5/1989 | Patel | |
| 5,121,309 | A | 6/1992 | Ewing et al. | |
| 5,597,234 | A | 1/1997 | Winkelhake | |
| 5,707,143 | A | 1/1998 | Hentz | |
| 5,738,436 | A | 4/1998 | Cummings et al. | |
| 5,868,493 | A | 2/1999 | Winkelhake | |
| 5,951,151 | A | 9/1999 | Doubeck et al. | |
| 6,168,299 | B1 | 1/2001 | Yan | |
| 6,343,873 | B1 | 2/2002 | Eberhard et al. | |
| 6,350,046 | B1 | 2/2002 | Lau | |
| 6,361,193 | B1 | 3/2002 | Gabrius et al. | |
| 6,367,945 | B2 | 4/2002 | Quiogue et al. | |
| 6,375,338 | B1 | 4/2002 | Cummings et al. | |
| 6,431,723 | B1 | 8/2002 | Schubert et al. | |
| 6,554,457 | B1 | 4/2003 | Platt | |
| 6,565,230 | B2 | 5/2003 | Ashley | |
| 6,899,445 | B2 | 5/2005 | Hyder | |
| 7,168,825 | B2 | 1/2007 | McArthur | |
| 7,195,362 | B2 * | 3/2007 | Kumagai | 362/12 |
| 7,370,988 | B2 | 5/2008 | Hagen | |
| 7,500,766 | B1 | 3/2009 | Reynolds | |
| 7,614,769 | B2 | 11/2009 | Sell | |
| 7,670,021 | B2 | 3/2010 | Chou | |
| 7,722,213 | B2 | 5/2010 | Inoue et al. | |
| 7,722,227 | B2 | 5/2010 | Zhang et al. | |
| 7,736,031 | B1 | 6/2010 | Rashidi | |
| 7,789,522 | B2 | 9/2010 | Steadman | |
| 7,862,214 | B2 | 1/2011 | Trott et al. | |
| 7,959,332 | B2 | 6/2011 | Tickner et al. | |
| 8,042,973 | B2 | 10/2011 | Inoue et al. | |
| 8,047,687 | B2 | 11/2011 | Inoue et al. | |
| 8,057,070 | B2 | 11/2011 | Negley et al. | |
| 8,070,328 | B1 | 12/2011 | Knoble et al. | |
| 8,079,736 | B2 | 12/2011 | Inoue et al. | |
| 8,096,686 | B2 | 1/2012 | Wilcox | |
| 8,128,263 | B2 | 3/2012 | Higuchi et al. | |
| 8,465,182 | B1 * | 6/2013 | Davis | F21V 21/042 248/342 |
| 2007/0058374 | A1 * | 3/2007 | Dupre | 362/341 |
| 2007/0256369 | A1 * | 11/2007 | Webb et al. | 52/79.13 |
| 2008/0084701 | A1 | 4/2008 | Van De Ven et al. | |
| 2008/0106907 | A1 * | 5/2008 | Trott et al. | 362/368 |
| 2009/0080189 | A1 | 3/2009 | Wegner | |
| 2009/0097262 | A1 * | 4/2009 | Zhang et al. | 362/364 |
| 2009/0129086 | A1 | 5/2009 | Thompson, III | |
| 2010/0053950 | A1 | 3/2010 | Higuchi et al. | |
| 2010/0061108 | A1 | 3/2010 | Zhang et al. | |
| 2010/0110699 | A1 | 5/2010 | Chou | |
| 2010/0128491 | A1 | 5/2010 | Hashimoto et al. | |
| 2010/0226139 | A1 | 9/2010 | Lynch et al. | |
| 2010/0265725 | A1 * | 10/2010 | Wilcox | 362/364 |
| 2011/0069499 | A1 | 3/2011 | Trott et al. | |
| 2011/0075411 | A1 | 3/2011 | Van De Ven et al. | |
| 2011/0075414 | A1 | 3/2011 | Van De Ven et al. | |
| 2011/0075422 | A1 | 3/2011 | Van De Ven et al. | |
| 2011/0075423 | A1 | 3/2011 | Van De Ven et al. | |
| 2011/0170298 | A1 | 7/2011 | Anaokar et al. | |
| 2011/0211346 | A1 | 9/2011 | Ogawa et al. | |
| 2011/0216534 | A1 | 9/2011 | Tickner et al. | |
| 2012/0039067 | A1 * | 2/2012 | Kim et al. | 362/84 |
| 2012/0188780 | A1 * | 7/2012 | Wilk | 362/509 |
| 2012/0218764 | A1 * | 8/2012 | Williamson et al. | 362/294 |
| 2013/0100650 | A1 * | 4/2013 | Beregszaszi | 362/145 |

* cited by examiner

LED LIGHT ENGINES

RELATED APPLICATION

This application claims the benefit of U.S. Provisional application No. 61/687,056, filed Apr. 17, 2012, entitled "LED light engines," the disclosure of which is hereby incorporated by reference in its entirety.

FIELD OF THE INVENTION

Embodiments of the invention relate to light-emitting diode ("LED") light engines, and more particularly to LED light engines that can be provided in new recessed downlight fixtures or retrofitted into existing recessed downlight fixtures.

BACKGROUND

LEDs provide many benefits compared to traditional incandescent and fluorescent lighting technologies that make them increasingly attractive for use in lighting applications. For example, LEDs convert much more of the consumed energy to light than, e.g., incandescent light bulbs, and are generally more energy efficient than these traditional light sources. LEDs also last longer than these sources and contain no hazardous chemicals, making them a more environmentally attractive option for lighting needs.

For at least some of these reasons, LEDs have been installed into new lighting fixtures and have been retrofitted into existing lighting fixtures. Challenges arise in retrofitting LEDs into existing fixtures where the LED lighting unit is sized differently from the existing fixtures.

In addition, because light from LEDs is generated from electronic components that are more susceptible to adverse environmental conditions than traditional light engines (e.g., incandescent or fluorescent light bulbs), it may be desirable to protect the LED components from these environmental conditions.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention relate to LED light engines that can be provided in new recessed downlight fixtures or retrofitted into existing recessed downlight fixtures to permit easy upgrading of the fixtures from a conventional light source fixture to an LED light source fixture.

In one embodiment, an LED light engine includes a housing, one or more LEDs mounted on a printed circuit board and a retention feature engaged with the housing. The retention feature may include one or more of a torsion spring and a friction clip and is configured to engage an inside wall of a recessed lighting can, thereby retaining the LED light engine within the can.

The torsion spring may include arms for engaging the inside wall of the can, and the friction clip may include arms and/or teeth for engaging the inside wall of the can.

In certain embodiments, the housing includes a plurality of tiers, each of the plurality of tiers located at a different distance from the center of the housing. At least one aperture is located on each of the plurality of tiers for retaining one or more friction clips. One end of the friction clip may be U-shaped and at least partially received in the at least one aperture.

In other embodiments the retention feature includes at least one torsion spring and at least one friction clip.

In some embodiments a reflector and lens are retained within the housing by a groove located on the inner wall of the housing. The housing, reflector and lens may form a sealed chamber for protecting the one or more LEDs from environmental conditions outside the chamber.

Yet other embodiments include methods for retrofitting an existing recessed downlight fixture which include removing the existing light engine from the can and inserting an LED light engine into the can. The LED light engine includes a retention feature such as a torsion spring or friction clip for engaging the can to retain the LED light engine within the can.

BRIEF DESCRIPTION OF THE DRAWINGS

Illustrative embodiments of the present invention are described in detail below with reference to the following drawing figures.

DETAILED DESCRIPTION

Figure 1:
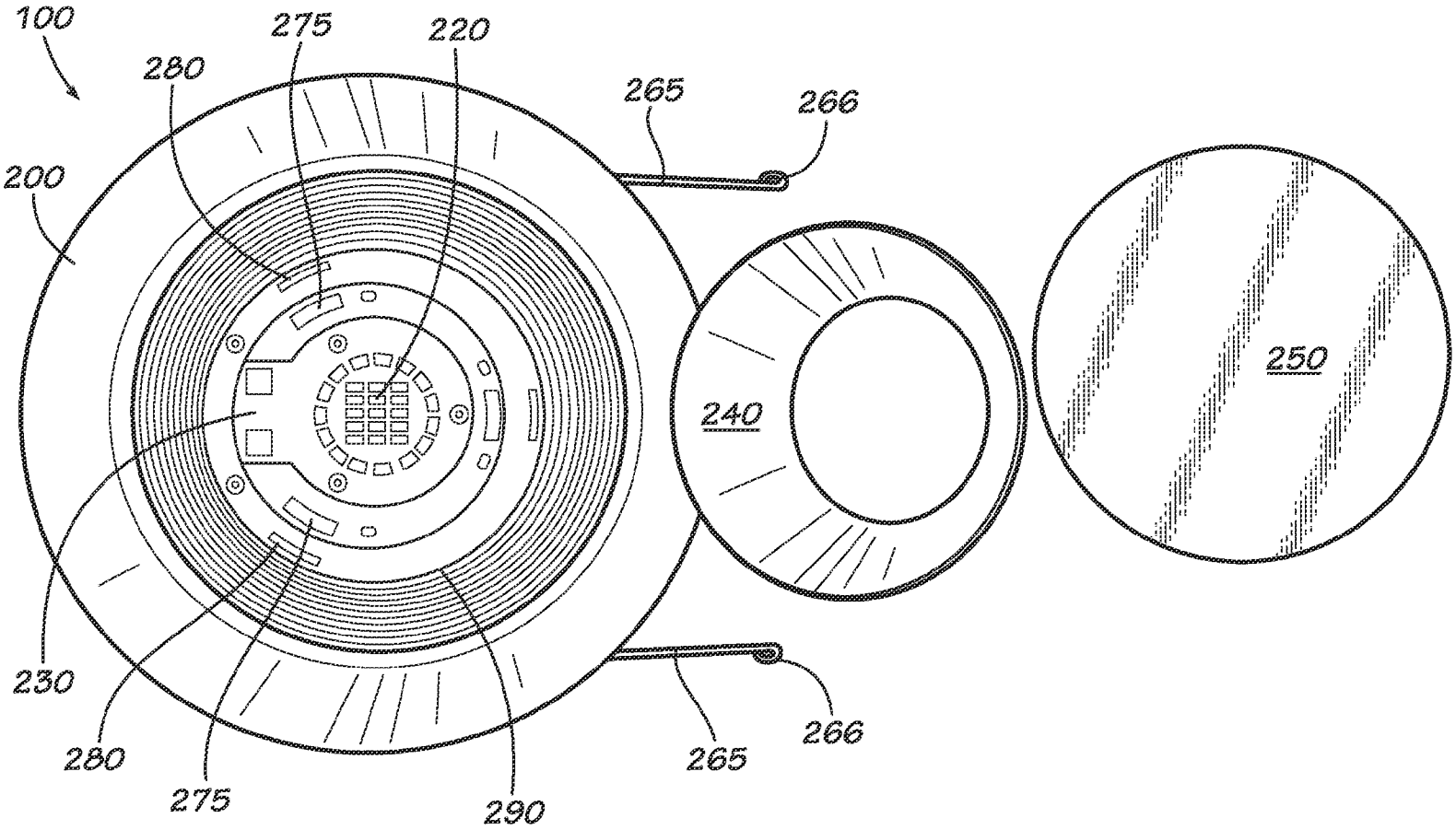
FIG. 1 is a bottom view of a light engine and associated components according to an embodiment of the invention.
Figure 2:
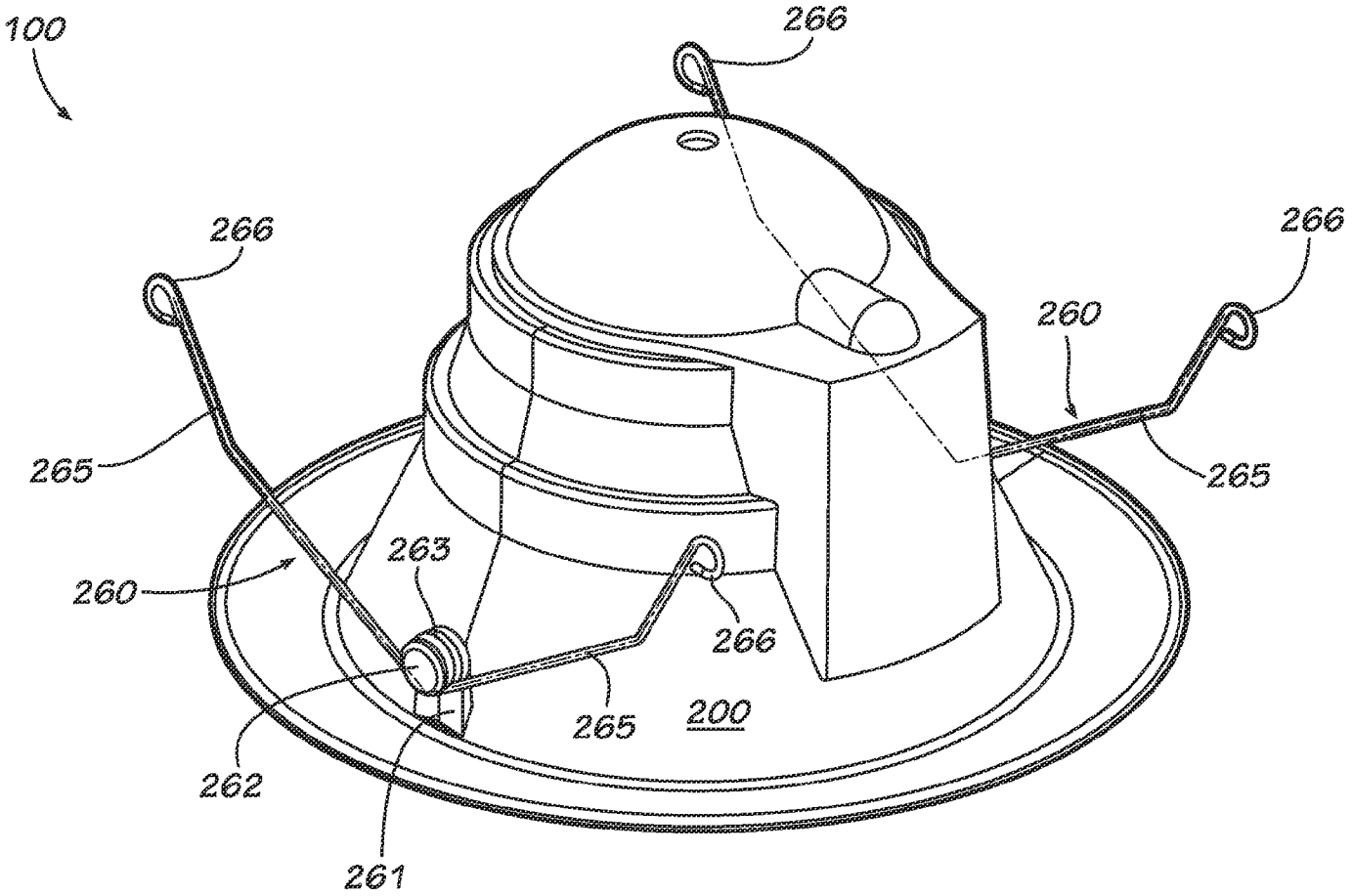
FIG. 2 is a top perspective view of a light engine according to one embodiment of the invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

With reference to FIGS. 1-7, embodiments of an LED light engine 100 include a housing 200, LEDs 220 mounted on a printed circuit board 230, a reflector 240, and a lens 250. In use, an LED light engine 100 is inserted into and retained within a can 300 recessed within a ceiling 400. See FIG. 3, which shows (in section) two cans 300—a wide can 300(*a*), such as but not limited to a 5" diameter recessed lighting can, and a relatively narrower can 300(*b*), such as but not limited to a 4" diameter recessed lighting can.

The LED light engine 100 may be retained in the can 300 in a variety of ways. In one embodiment (see FIGS. 2 and 6), torsion springs 260 are provided on the housing 200. In use, the arms 265 of the torsion springs 260 are forced toward each other so that the light engine 100 may be inserted into the can 300. After insertion, the arms 265 return to their preloaded state, bearing against a torsion spring bracket (not shown) located on the inner surface of the can 300. As the light engine 100 is inserted into the can 300, the arms 265 open up, continually pushing against the torsion spring bracket, retaining the light engine 100 within the can and preventing it from sliding down and out of the can 300. A person skilled in the art would understand the interaction between the torsion spring 260 and the torsion spring bracket mounted on the can 300.

Torsion springs 260 may be mounted on a spring mount 261 located on the outside of the housing 200 by a fastener 262 inserted through the coiled portion 263 of the torsion spring 260 so that arms 265 protrude in generally opposite directions. Arms 265 terminate in loops 266 that provide good sliding contact with the sides of the can 300.

In other embodiments (see FIGS. 3-6), the housing 200 includes at least one slot or aperture 275, 280 for receiving a first end 271 of a friction clip 270. The friction clip 270 may be formed from a metal plate or strap, and the first end 271 may be bent into a U-shape that is partially received in the aperture 275, 280 provided in the housing 200. A second end 276 of the friction clip 270 may include clip arms 272, each clip arm having saw-tooth ends/teeth 274. When the light engine 100 is inserted into the can 300, clip arms 272 angle downwardly and teeth 274 engage the inside wall of the can 300, retaining the light engine 100 in the can.

Sets of apertures may be provided on different tiers of the housing 200, such as upper tier apertures 275 and lower tier apertures 280. In this way, the installer may best position the friction clips 270 to engage a particular sized can 300. For example, as shown in FIG. 3 (see also FIG. 7), friction clips 270 may engage upper tier apertures 275 to engage a relatively narrow can 300(*b*) or could engage lower tier apertures 280 to engage a wider can 300(*a*).

Figure 7:
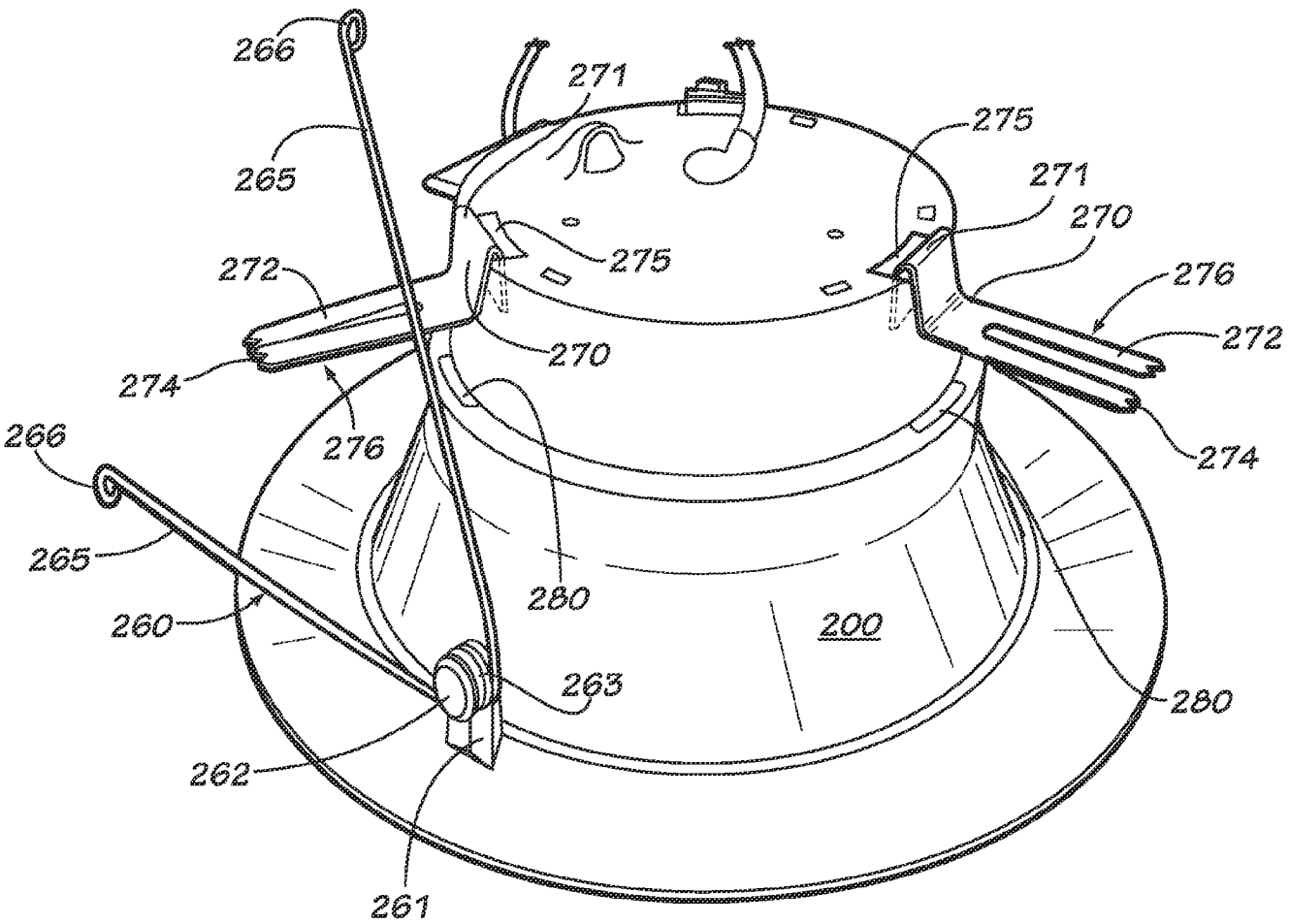
FIG. 7 is a top perspective view of a light engine according to various embodiments of the invention.

Some embodiments of the LED light engine 100 may have dual mounting features such that both torsion springs 260 and friction clips 270 are provided to mount the light engine 100, as illustrated in FIG. 7.

Figure 3:
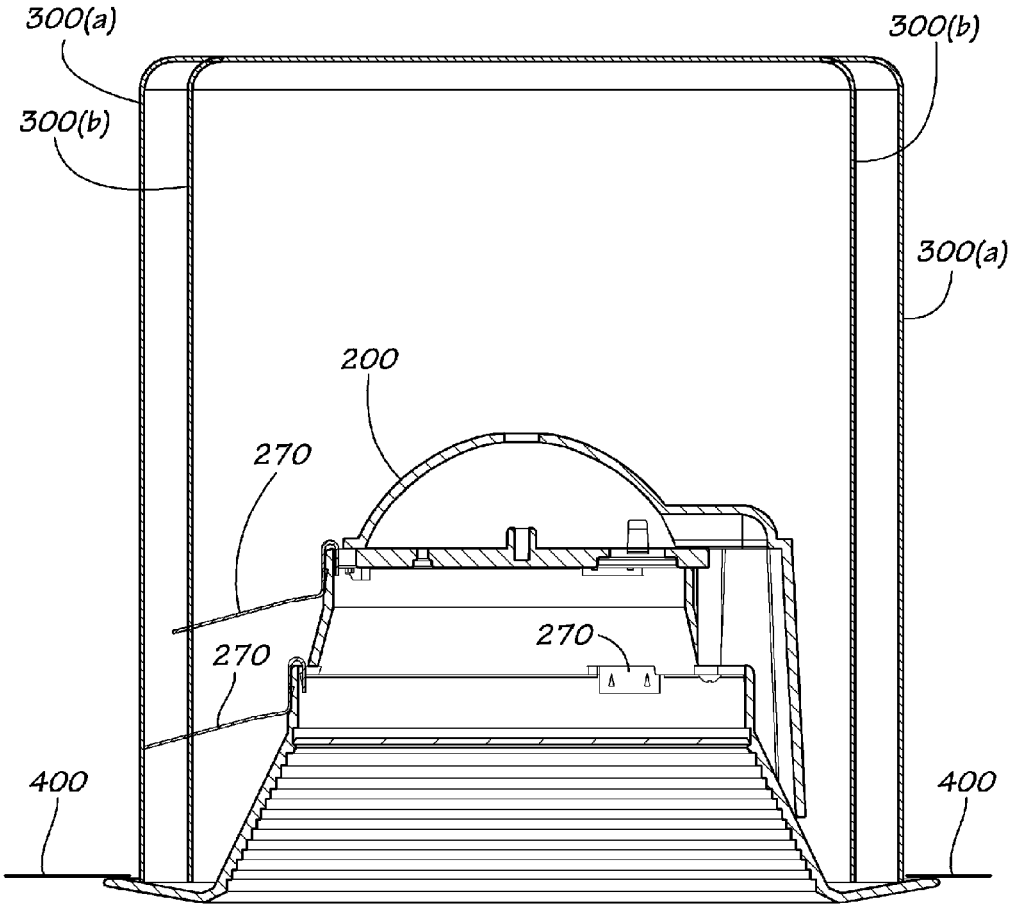
FIG. 3 is a side view of an installed light engine according to an embodiment of the invention.
Figure 4:
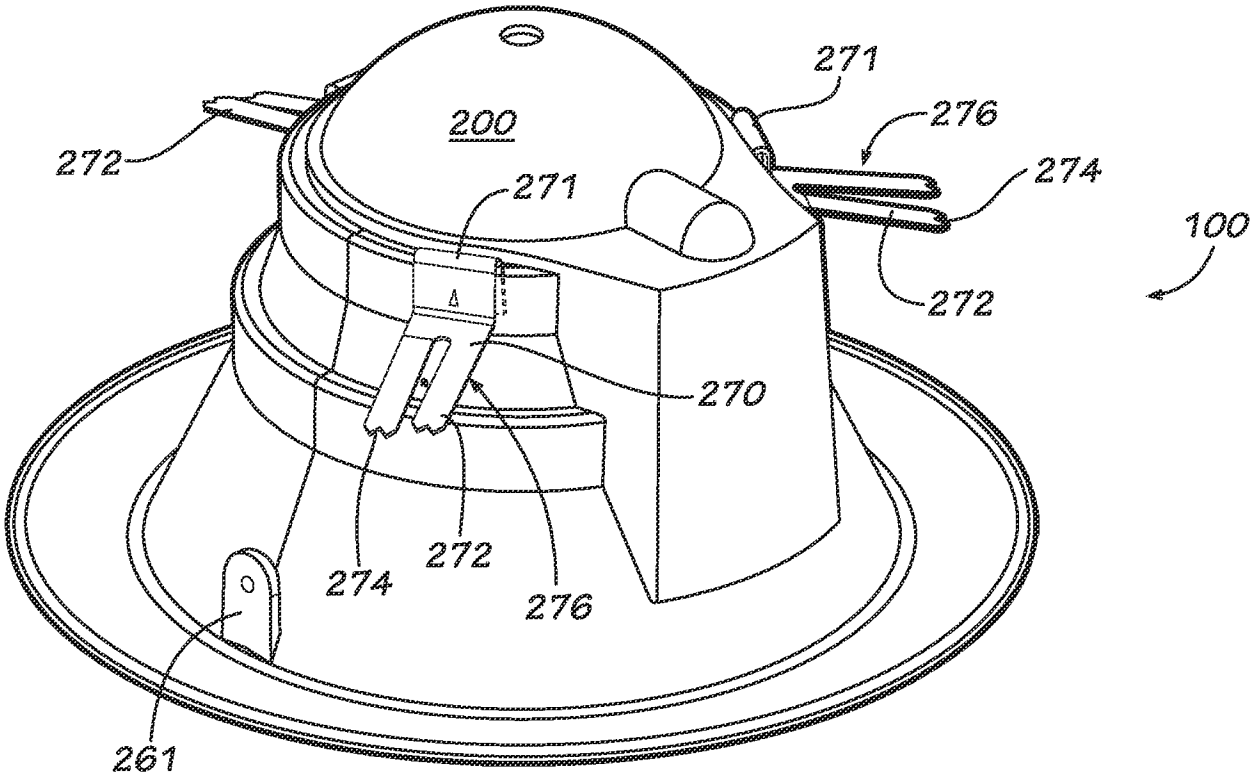
FIG. 4 is a top perspective view of a light engine according to another embodiment of the invention.
Figure 5:
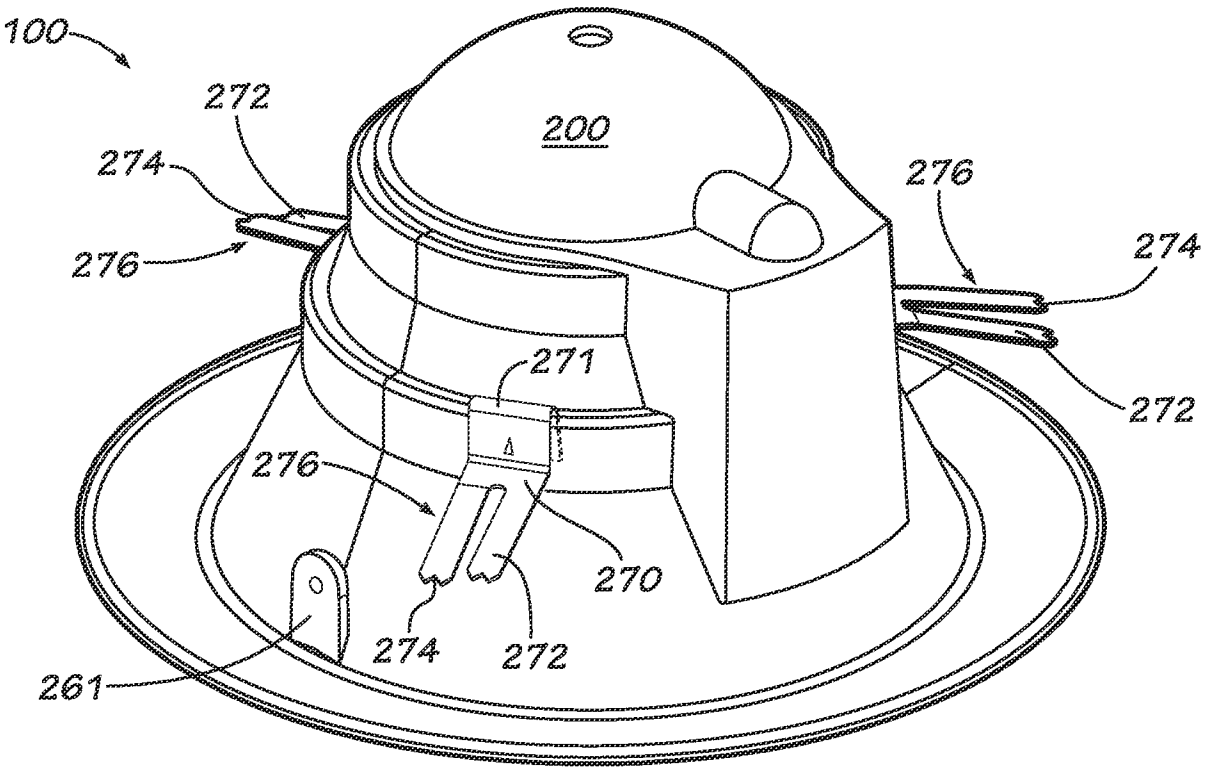
FIG. 5 is a top perspective view of a light engine according to yet another embodiment of the invention.
Figure 6:
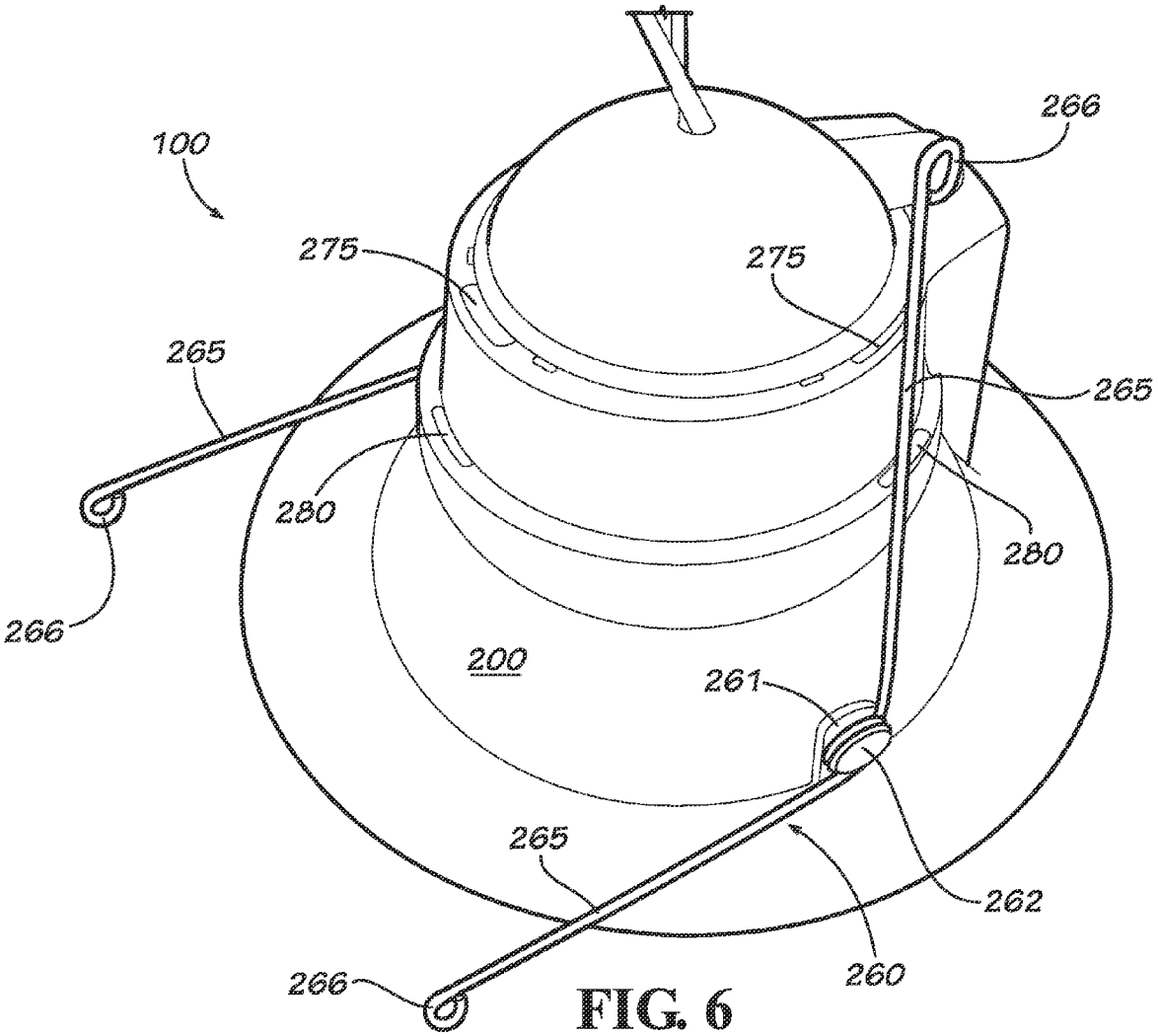
FIG. 6 is a top perspective view of a light engine according to embodiments of the invention.

The torsion springs 260 and the multi-positionable friction clips 270 accommodate different sizes of existing cans (e.g., 300(*a*) and 300(*b*)) and permit the light engine 100 to be fitted into a wide variety of different sized cans 300, as illustrated in FIG. 3.

Figures 8, 8A:
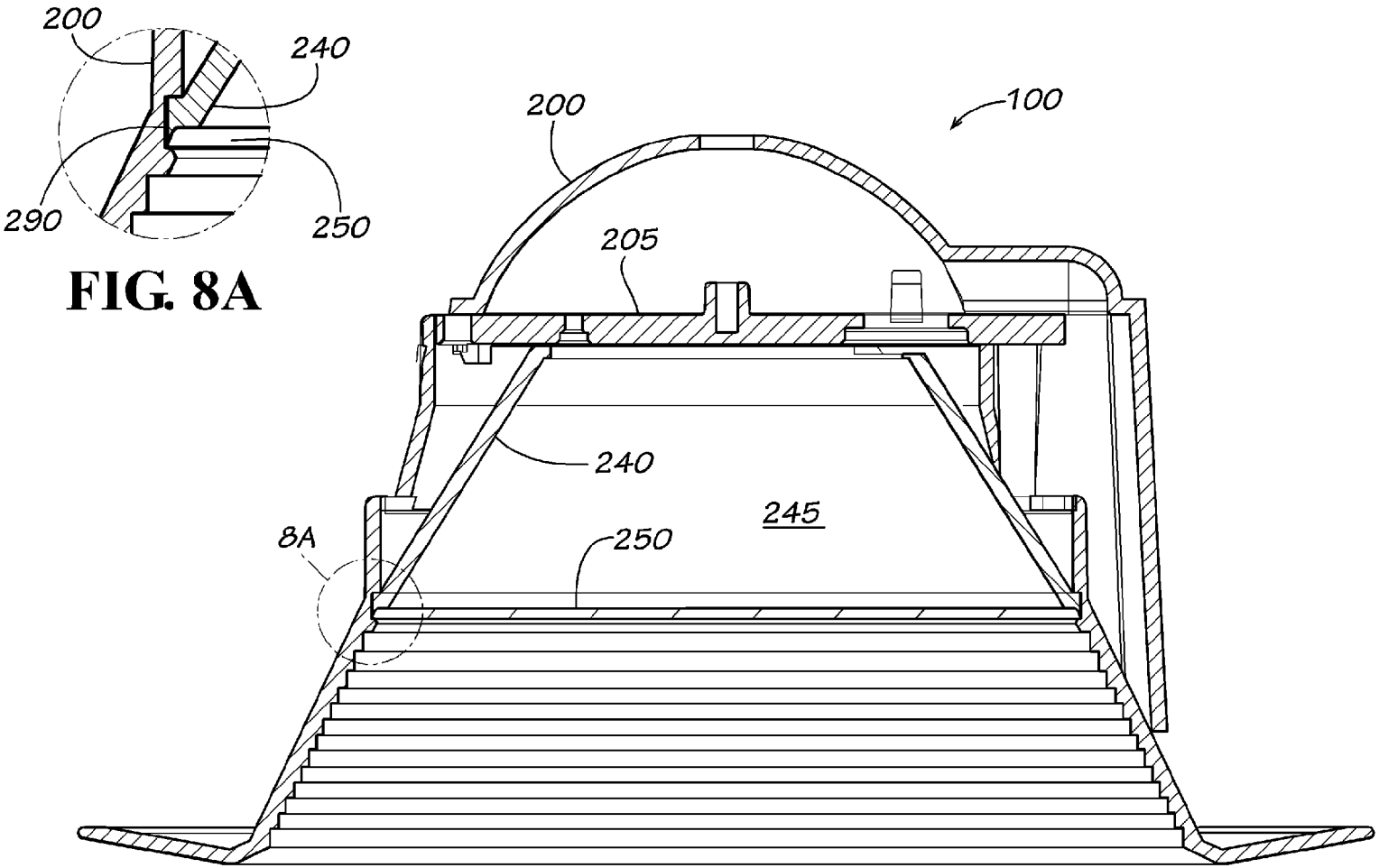
FIG. 8 is a side view of a light engine according to an embodiment of the invention.
FIG. 8A is an enlarged portion of the light engine of FIG. 8.
Figure 9:
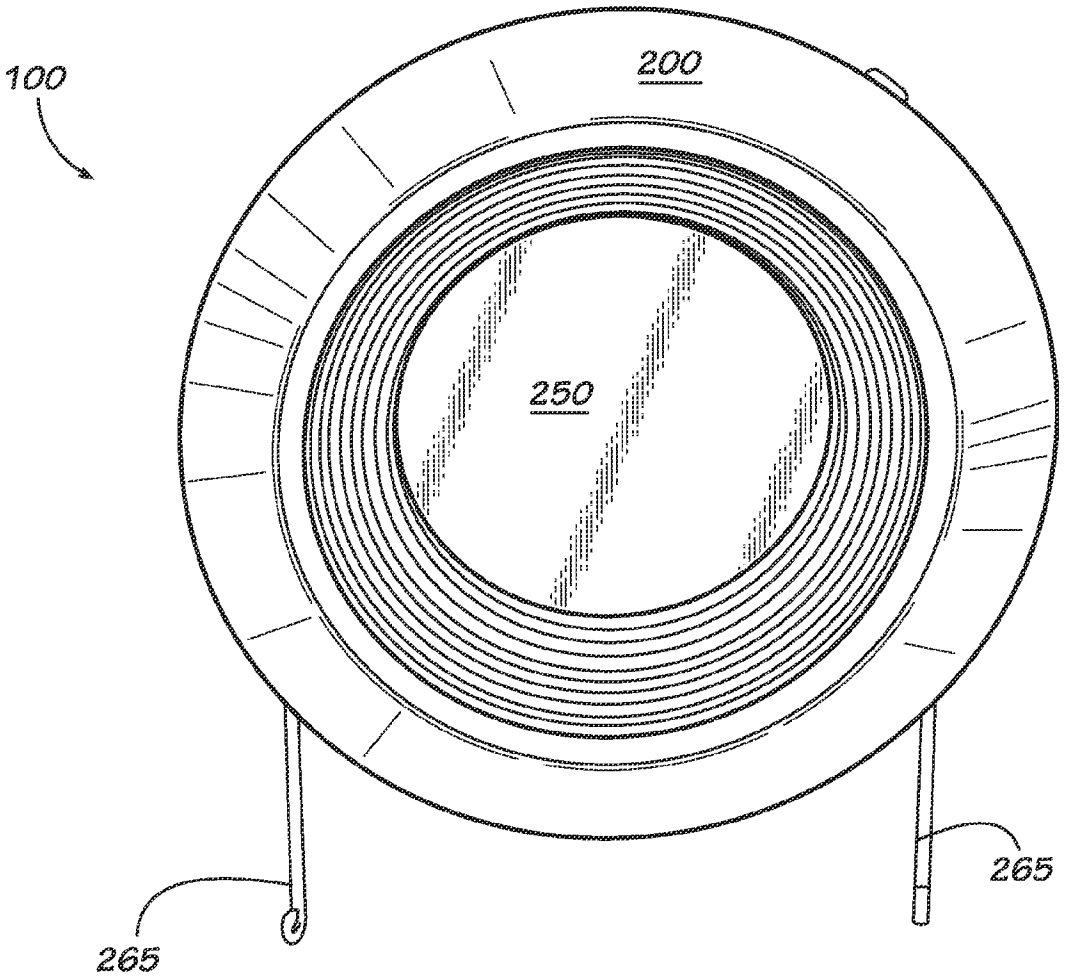
FIG. 9 is a bottom view of a light engine according to the embodiment of FIG. 8.

As depicted in FIGS. 8, 8A and 9, in some embodiments a lens 250 may be attached to the light engine 100. The lens 250 snaps into the light engine 100. More specifically, the lens 250 is snapped into a groove 290 provided in the inner wall of the housing 200. See FIG. 8, and more specifically FIG. 8A, which is an enlarged portion of FIG. 8 illustrating the interaction between the groove 290, lens 250 and reflector 240. In such embodiments, no additional mounting features are needed to retain the lens 250 within the light engine 100.

An inner reflector 240 may also be positioned within the light engine 100 above the lens 250 and also received in the groove 290. When the lens 250 is subsequently inserted into the groove 290, the reflector 240 is pressed against the top 205 of the light engine housing 200 to create a sealed environment and prevent environmental conditions such as bugs, dirt, and debris from entering the optical chamber 245. The sealed environment protects the optical chamber 245 and electronic components located therein (including the LEDs 220) from these environmental conditions.

The components described herein may be formed from known lighting fixture materials. For example, the housing may be formed from casted aluminum or other metallic or polymeric materials. The reflector may be formed from metallic or polymeric materials and may have a reflective or diffuse inner surface for reflecting light from the LEDs in a desired light distribution profile. The lens may be clear or diffuse (e.g., frosted) depending on the desired application and could be formed from glass or polymeric materials. The torsion springs and friction clips may be formed from metallic materials such as carbon or stainless steel or even from suitable polymeric materials.

Another embodiment of the invention relates to a method for retrofitting an existing recessed downlight fixture having, e.g., an incandescent or fluorescent light engine, with an LED light engine. The method includes removing the existing light engine without removing the can in which the existing light engine is housed and installing a light engine having features such as those described above into the can.

Specifically, the light engine 100 according to the method may include retention features such as the torsion springs 260 and/or friction clips 270 described above and illustrated in the figures. The retention features engage the installed can 300, retaining the light engine 100 within the can 300. The light engine 100 may also include a reflector 240 and lens 250 retained within a groove 290 in the inner wall of the housing 200 of the light engine.

The method thus allows for fast and easy replacement of traditional light engines with LED light engines.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. An LED light engine comprising:

a housing comprising a central axis, an upper tier having an upper tier diameter, and a lower tier having a lower tier diameter, wherein the upper tier diameter is smaller than the lower tier diameter;

one or more LEDs mounted on a printed circuit board; and at least one retention feature engaged with the housing, wherein the at least one retention feature comprises one or more friction clips, wherein the housing further comprises at least one upper tier aperture located on the upper tier of the housing at a first lateral distance from the central axis of the housing for retaining the one or more friction clips and at least one lower tier aperture located on the lower tier of the housing at a second lateral distance from the central axis of the housing for retaining the one or more friction clips, the first lateral distance being smaller than the second lateral distance, wherein, when the one or more friction clips is engaged in the at least one upper tier aperture, the one or more friction clips engage an inside wall of a first recessed lighting can having a first can diameter to thereby retain the LED light engine within the first recessed lighting can and wherein, when the one or more friction clips is engaged in the at least one lower tier aperture, the one or more friction clips engage an inside wall of a second recessed lighting can having a second can diameter larger than the first can diameter to thereby retain the LED light engine within the second recessed lighting can.

2. The LED light engine of claim 1, further comprising a reflector and a lens retained within the housing.

3. The LED light engine of claim 2, wherein the housing further comprises an inner wall and wherein the reflector and lens are retained within the housing by a groove located on the inner wall of the housing.

4. The LED light engine of claim 3, wherein the reflector is located between the housing and the lens and wherein the housing, reflector and lens form a sealed chamber for protecting the one or more LEDs from environmental conditions outside the chamber.

5. The LED light engine of claim 1, wherein the at least one retention feature further comprises a torsion spring and wherein the torsion spring comprises a pair of arms for engaging the inside wall of the first or second recessed lighting can, each of the arms terminating in a loop for contacting the inside wall of the first or second recessed lighting can.

6. The LED light engine of claim 1, wherein the one or more friction clips comprise a first end and a second end, wherein the first end is U-shaped and engages the at least one upper tier aperture or the at least one lower tier aperture and wherein the second end comprises a plurality of arms for engaging the inside wall of the first or second recessed lighting can.

7. The LED light engine of claim 6, wherein each of the plurality of arms comprise a plurality of teeth at a distal end of the arm for contacting the inside wall of the first or second recessed lighting can.

8. The LED light engine of claim 1, wherein the at least one retention feature is removably engaged with the housing.

9. A method for installing an LED light engine into a first recessed lighting can having a first can diameter or a second recessed lighting can having a second can diameter larger than the first can diameter, the LED light engine comprising:

a housing comprising a central axis, an upper tier having an upper tier diameter, and a lower tier having a lower tier diameter, wherein the upper tier diameter is smaller than the lower tier diameter;

one or more LEDs mounted on a printed circuit board; and at least one retention feature engaged with the housing, wherein the at least one retention feature comprises one or more friction clips, wherein the housing further comprises at least one upper tier aperture located on the upper tier of the housing at a first lateral distance from the central axis of the housing for retaining the one or more friction clips and at least one lower tier aperture located on the lower tier of the housing at a second lateral distance from the central axis of the housing for retaining the one or more friction clips, the first lateral distance being smaller than the second lateral distance, wherein the method comprises:

positioning the one or more friction clips in the at least one upper tier aperture or positioning the one or more friction clips in the at least one lower tier aperture; and either:

inserting the LED light engine into the first recessed lighting can if the one or more friction clips are positioned in the at least one upper tier aperture, wherein the one or more friction clips engage an inside wall of the first recessed lighting can to thereby retain the LED light engine within the first recessed lighting can; or inserting the LED light engine into the second recessed lighting can if the one or more friction clips are positioned in the at least one lower tier aperture, wherein the one or more friction clips engage an inside wall of the second recessed lighting can to thereby retain the LED light engine within the second recessed lighting can.

10. The method of claim 9, further comprising a reflector and a lens retained within the housing.

11. The method of claim 10, wherein the housing further comprises an inner wall and wherein the reflector and lens are retained within the housing by a groove located on the inner wall of the housing.

12. The method of claim 11, wherein the reflector is located between the housing and the lens and wherein the housing, reflector and lens form a sealed chamber for protecting the one or more LEDs from environmental conditions outside the chamber.

13. The method of claim 9, wherein the at least one retention feature further comprises a torsion spring and wherein the torsion spring comprises a pair of arms for engaging the inside wall of the first or second recessed lighting can, each of the arms terminating in a loop for contacting the inside wall of the first or second recessed lighting can.

14. The method of claim 9, wherein the one or more friction clips comprise a first end and a second end, wherein the first end is U-shaped and engages the at least one upper tier aperture or the at least one lower tier aperture and wherein the second end comprises a plurality of arms for engaging the inside wall of the first or second recessed lighting can.

15. The method of claim 14, wherein each of the plurality of arms comprise a plurality of teeth at a distal end of the arm for contacting the inside wall of the first or second recessed lighting can.

* * * * *